US011268173B2

(12) United States Patent
Mizutani et al.

(10) Patent No.: US 11,268,173 B2
(45) Date of Patent: Mar. 8, 2022

(54) MAGNESIUM ALLOY AND MAGNESIUM ALLOY MEMBER

(71) Applicants: Sumitomo Electric Industries, Ltd., Osaka (JP); NATIONAL UNIVERSITY CORPORATION UNIVERSITY OF TOYAMA, Toyama (JP)

(72) Inventors: Manabu Mizutani, Osaka (JP); Katsuhito Yoshida, Osaka (JP); Seiji Saikawa, Toyama (JP)

(73) Assignees: Sumitomo Electric Industries, Ltd., Osaka (JP); National University Corporation University of Toyama, Toyama (JP)

( * ) Notice: Subject to any disclaimer, the term of this patent is extended or adjusted under 35 U.S.C. 154(b) by 29 days.

(21) Appl. No.: 16/763,791

(22) PCT Filed: Nov. 15, 2018

(86) PCT No.: PCT/JP2018/042279

§ 371 (c)(1),
(2) Date: May 13, 2020

(87) PCT Pub. No.: WO2019/098269

PCT Pub. Date: May 23, 2019

(65) Prior Publication Data

US 2020/0354819 A1 Nov. 12, 2020

(30) Foreign Application Priority Data

Nov. 17, 2017 (JP) ..... JP2017-221519
Nov. 17, 2017 (JP) ..... JP2017-221520

(51) Int. Cl.
*C22C 23/02* (2006.01)
*C22F 1/06* (2006.01)

(52) U.S. Cl.
CPC ..... *C22C 23/02* (2013.01); *C22F 1/06* (2013.01)

(58) Field of Classification Search
CPC ..... C22C 23/02; C22F 1/06
(Continued)

(56) References Cited

U.S. PATENT DOCUMENTS 5,872,699 A * 2/1999 Nishii ..... G06F 1/203 361/699
2006/0222556 A1 10/2006 Hijii et al.
(Continued)

FOREIGN PATENT DOCUMENTS

CN 101476072 A 7/2009
CN 104250697 A 12/2014
(Continued)

*Primary Examiner* — Jie Yang
(74) *Attorney, Agent, or Firm* — Faegre Drinker Biddle & Reath LLP

(57) ABSTRACT

A magnesium alloy containing Al, Sr, Ca, and Mn, with the balance being Mg and inevitable impurities, the magnesium alloy having: a structure having an α-Mg phase, and a precipitate dispersed in at least one of a grain boundary of the α-Mg phase and a cell boundary, the precipitate including: at least one phase selected from a group A consisting of an $Al_2Sr$ phase, an $Al_4Sr$ phase, a $(Mg, Al)_2Sr$ phase, and a $(Mg, Al)_4Sr$ phase; and at least one phase selected from a group B consisting of an $Al_2Ca$ phase and a $(Mg, Al)_2Ca$ phase, the magnesium alloy having, in a cross section, a total area rate of a group A precipitate and a group B precipitate of greater than or equal to 2.5% and less than or equal to 30%.

3 Claims, 2 Drawing Sheets

(58) Field of Classification Search
USPC ..... 420/410
See application file for complete search history.

(56) References Cited

U.S. PATENT DOCUMENTS

| | | | |
|---|---|---|---|
| 2011/0220251 | A1 | 9/2011 | Okamoto et al. |
| 2012/0282131 | A1 | 11/2012 | Mizuno et al. |
| 2017/0283915 | A1 | 10/2017 | Oishi et al. |
| 2018/0371583 | A1 | 12/2018 | Mizutani et al. |

FOREIGN PATENT DOCUMENTS

| | | | |
|---|---|---|---|
| JP | 2005-113260 | A | 4/2005 |
| JP | 2006-291327 | A | 10/2006 |
| JP | 2010-116620 | A | 5/2010 |
| JP | 2010-242146 | A | 10/2010 |
| JP | 2016-79451 | A | 5/2016 |
| JP | 2016-108654 | A | 6/2016 |
| JP | 2017-160495 | A | 9/2017 |
| JP | 6329714 | B1 | 5/2018 |

* cited by examiner

MAGNESIUM ALLOY AND MAGNESIUM ALLOY MEMBER

TECHNICAL FIELD

The present disclosure relates to a magnesium alloy and a magnesium alloy member. This application claims priority of Japanese Patent Application No. 2017-221519, filed on Nov. 17, 2017, and Japanese Patent Application No. 2017-221520, filed on Nov. 17, 2017. The entire contents described in the Japanese patent applications are incorporated herein by reference.

BACKGROUND ART

Magnesium alloys have attracted attention as a lightweight material because they have the lowest specific gravity among practical metals and are excellent in specific strength and specific rigidity. PTL 1 discloses a magnesium alloy containing Al, Sr, Ca, and Mn, with the balance being Mg and inevitable impurities. Further, PTL 2 discloses a cast member containing a magnesium alloy (the cast member is referred to as a magnesium alloy member) having thicknesses different between component parts.

CITATION LIST

Patent Literature

PTL 1: Japanese Patent Laying-Open No. 2010-242146
PTL 2: Japanese Patent Laying-Open No. 2017-160495

SUMMARY OF INVENTION

The magnesium alloy according to the present disclosure is:

a magnesium alloy containing Al, Sr, Ca, and Mn, with the balance being Mg and inevitable impurities, the magnesium alloy having:

a structure having an α-Mg phase, and a precipitate dispersed in at least one of a grain boundary of the α-Mg phase and a cell boundary, the precipitate including:

at least one phase selected from a group A consisting of an $Al_2Sr$ phase, an $Al_4Sr$ phase, a $(Mg, Al)_2Sr$ phase, and a $(Mg, Al)_4Sr$ phase; and at least one phase selected from a group B consisting of an $Al_2Ca$ phase and a $(Mg, Al)_2Ca$ phase, the magnesium alloy having, in a cross section, a total area rate of a group A precipitate and a group B precipitate of greater than or equal to 2.5% and less than or equal to 30%.

The magnesium alloy member according to the present disclosure is:

a magnesium alloy member containing the above-mentioned magnesium alloy, and including a base part, and a plate part integrally molded with the base part to protrude from the base part, the base part having a thickness in a protruding direction of the plate part of greater than or equal to five times the thickness of the plate part.

DETAILED DESCRIPTION

Figure 1:
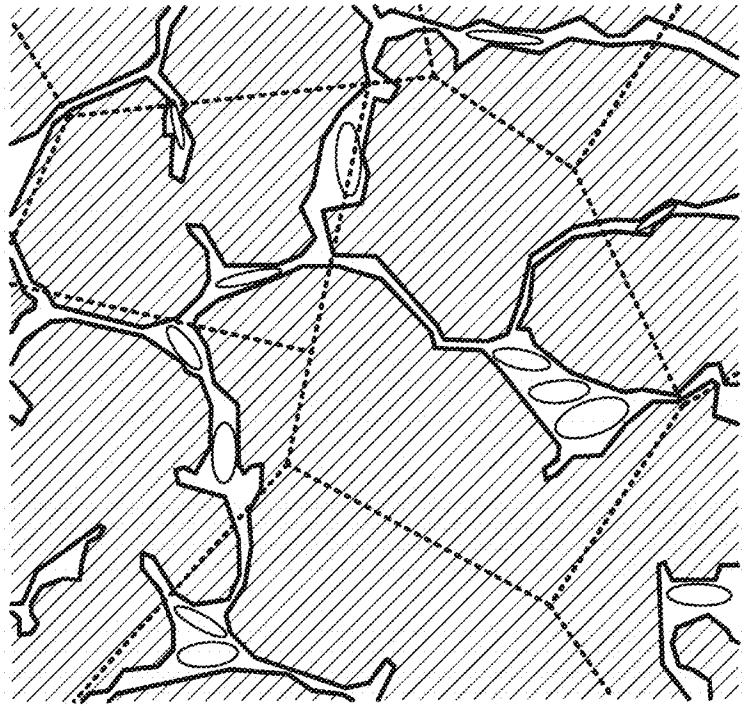
FIG. 1 is a schematic view showing a structure of a magnesium alloy.

Problem to be Solved by the Present Disclosure

A magnesium alloy excellent in high-temperature strength is desired to be developed. Components such as automobile components and aircraft components may be used at a usage environment temperature higher than normal temperature. For example, components installed near an engine room may be used at a usage environment temperature of about 100° C. to 180° C., and are desired to be excellent in strength at high temperatures.

Therefore, an object of the present disclosure is to provide a magnesium alloy excellent in high-temperature strength.

In addition, a magnesium alloy member that is unlikely to crack during casting is desired. For this reason, it is conceivable to employ, as a magnesium alloy member, an integrally molded article having a large thickness variation and a complicated shape. For example, a magnesium alloy member may include a base part, and a plate part integrally molded with the base part to protrude from the base part, and may have a large difference in thickness between the base part and the plate part.

A magnesium alloy member that has a large thickness variation and is formed of an integrally molded article having a complicated shape, however, is likely to crack at a portion where the thickness varies, for example, at a boundary between a base part and a plate part during casting.

Therefore, an object of the present disclosure is to provide a magnesium alloy member that is unlikely to crack during casting.

Advantageous Effect of the Present Disclosure

The above-mentioned magnesium alloy is excellent in high-temperature strength. In addition, the above-mentioned magnesium alloy member is unlikely to crack during casting.

DESCRIPTION OF EMBODIMENTS

First, contents of embodiments of the present disclosure will be listed and described.

(1) A magnesium alloy according to an embodiment of the present disclosure is:

a magnesium alloy containing Al, Sr, Ca, and Mn, with the balance being Mg and inevitable impurities, the magnesium alloy having:

a structure having an α-Mg phase, and a precipitate dispersed in at least one of a grain boundary of the α-Mg phase and a cell boundary, the precipitate including:

at least one phase selected from a group A consisting of an $Al_2Sr$ phase, an $Al_4Sr$ phase, a $(Mg, Al)_2Sr$ phase, and a $(Mg, Al)_4Sr$ phase; and at least one phase selected from a group B consisting of an $Al_2Ca$ phase and a $(Mg, Al)_2Ca$ phase, the magnesium alloy having, in a cross section, a total area rate of a group A precipitate and a group B precipitate of greater than or equal to 2.5% and less than or equal to 30%.

The group A precipitate and the group B precipitate contribute to the improvement of the high-temperature strength. Since the magnesium alloy has the group A precipitate and the group B precipitate in a specific range, the magnesium alloy is excellent in high-temperature strength. Specifically, since the magnesium alloy has, in a cross section, a total area rate of the group A precipitate and the group B precipitate of greater than or equal to 2.5%, the magnesium alloy can exhibit practically sufficient high-temperature strength. The larger the total area rate of the group A precipitate and the group B precipitate in a cross section is, the more the high-temperature strength can be improved. Too large a total area rate, however, tends to allow for the presence of precipitates that reduce the high-temperature strength. Therefore, since the total area rate of the group A precipitate and the group B precipitate in a cross section is less than or equal to 30%, less or substantially no precipitates that reduce the high-temperature strength are present, and the reduction of the high-temperature strength can be suppressed.

(2) In an example of the magnesium alloy, the precipitate further includes at least one phase selected from a group C consisting of an $Al_{17}Sr_8$ phase and a $Mg_{17}Sr_2$ phase, and the magnesium alloy has, in a cross section, an area rate of a group C precipitate of less than or equal to 15%.

The group C precipitate reduces the high-temperature strength. Therefore, when the magnesium alloy has the group C precipitate, and has, in a cross section, an area rate of the group C precipitate of less than or equal to 15%, the reduction of the high-temperature strength can be suppressed.

(3) In an example of the magnesium alloy having the group C precipitate, the magnesium alloy has, in a cross section, a total area rate of the group A precipitate and the group B precipitate of greater than or equal to 10% and less than or equal to 25%.

When the magnesium alloy has the group C precipitate, and has, in a cross section, a total area rate of the group A precipitate and the group B precipitate of greater than or equal to 10%, the reduction of the high-temperature strength can be readily suppressed even when the area rate of the group C precipitate is relatively large. Further, when the magnesium alloy has the group C precipitate, and has, in a cross section, a total area rate of the group A precipitate and the group B precipitate of less than or equal to 25%, the crystallization of the group C precipitate as a precipitate that reduces the high-temperature strength can be readily suppressed.

(4) In an example of the magnesium alloy, the precipitate further includes a $Mg_{17}Al_{12}$ phase, and the magnesium alloy has, in a cross section, an area rate of the $Mg_{17}Al_{12}$ phase of less than or equal to 10%.

The $Mg_{17}Al_{12}$ phase reduces the high-temperature strength. Therefore, when the magnesium alloy has the $Mg_{17}Al_{12}$ phase, and has, in a cross section, an area rate of the $Mg_{17}Al_{12}$ phase of less than or equal to 10%, the reduction of the high-temperature strength can be suppressed.

(5) In an example of the magnesium alloy, the precipitate further includes:

at least one phase selected from a group C consisting of an $Al_{17}Sr_8$ phase and a $Mg_{17}Sr_2$ phase; and a $Mg_{17}Al_{12}$ phase, the magnesium alloy has, in a cross section:

a total area rate of the group A precipitate and the group B precipitate of greater than or equal to 15% and less than or equal to 25%;

an area rate of a group C precipitate of less than or equal to 7%; and an area rate of the $Mg_{17}Al_{12}$ phase of less than or equal to 5%.

The group C precipitate and the $Mg_{17}Al_{12}$ phase reduce the high-temperature strength. Therefore, when the magnesium alloy has both the group C precipitate and the $Mg_{17}Al_{12}$ phase, and has, in a cross section, an area rate of the group C precipitate of less than or equal to 7% and an area rate of the $Mg_{17}Al_{12}$ phase of less than or equal to 5%, the reduction of the high-temperature strength can be suppressed. When the magnesium alloy has both the group C precipitate and the $Mg_{17}Al_{12}$ phase, and has, in a cross section, a total area rate of the group A precipitate and the group B precipitate of greater than or equal to 15%, the reduction of the high-temperature strength can be readily suppressed even when the area rate of the group C precipitate or the $Mg_{17}Al_{12}$ phase is relatively large. Further, when the magnesium alloy has both the group C precipitate and the $Mg_{17}Al_{12}$ phase, and has, in a cross section, a total area rate of the group A precipitate and the group B precipitate of less than or equal to 25%, the crystallization of the group C precipitate can be readily suppressed.

(6) A magnesium alloy member according to an embodiment of the present disclosure is:

a magnesium alloy member containing the above-mentioned magnesium alloy, and including a base part, and a plate part integrally molded with the base part to protrude from the base part, the base part having a thickness in a protruding direction of the plate part of greater than or equal to five times the thickness of the plate part.

More specifically, the magnesium alloy member according to an embodiment of the present disclosure is:

a magnesium alloy member containing the magnesium alloy, and including a base part, and a plate part integrally molded with the base part to protrude from the base part, the magnesium alloy having a composition containing Al, Sr, Ca, and Mn, with the balance being Mg and inevitable impurities, and a structure having an α-Mg phase, and a precipitate dispersed in at least one of a grain boundary of the α-Mg phase and a cell boundary, the precipitate including:

at least one phase selected from a group A consisting of an $Al_2Sr$ phase, an $Al_4Sr$ phase, a $(Mg, Al)_2Sr$ phase, and a $(Mg, Al)_4Sr$ phase; and at least one phase selected from a group B consisting of an $Al_2Ca$ phase and a $(Mg, Al)_2Ca$ phase, the magnesium alloy having, in a cross section, a total area rate of a group A precipitate and a group B precipitate of greater than or equal to 2.5% and less than or equal to 30%, the base part having a thickness in a protruding direction of the plate part of greater than or equal to five times the thickness of the plate part.

The group A precipitate and the group B precipitate contribute to the improvement of the high-temperature strength. Since the magnesium alloy has the group A precipitate and the group B precipitate in a specific range, the magnesium alloy is excellent in high-temperature strength and is unlikely to crack during casting. Specifically, since the magnesium alloy has, in a cross section, a total area rate of the group A precipitate and the group B precipitate of greater than or equal to 2.5%, the magnesium alloy can exhibit practically sufficient high-temperature strength, and is unlikely to crack during casting. Too large a total area rate of the group A precipitate and the group B precipitate in a cross section tends to allow for the presence of precipitates that reduce the high-temperature strength. Therefore, since the total area rate of the group A precipitate and the group B precipitate in a cross section is less than or equal to 30%, less or substantially no precipitates that reduce the high-temperature strength are present, the reduction of the high-temperature strength can be suppressed, and the magnesium alloy is unlikely to crack during casting.

Since the magnesium alloy member contains the magnesium alloy having the precipitates that contribute to the improvement of the high-temperature strength in a specific range, the magnesium alloy member is unlikely to crack during casting even when it has a large thickness variation and has a complicated shape that includes a base part, and a plate part integrally molded with the base part.

(7) In an example of the magnesium alloy member, the base part has a length in a direction intersecting with the protruding direction of the plate part of greater than or equal to five times the thickness of the plate part.

In the magnesium alloy member, the degree of freedom of shapes of the base part and the plate part can be increased.

(8) In an example of the magnesium alloy member, the precipitate further includes at least one phase selected from a group C consisting of an $Al_{17}Sr_8$ phase and a $Mg_{17}Sr_2$ phase, and the magnesium alloy has, in a cross section, an area rate of a group C precipitate of less than or equal to 10%.

The group C precipitate reduces the high-temperature strength. Therefore, when the magnesium alloy has the group C precipitate, and has, in a cross section, an area rate of the group C precipitate of less than or equal to 10%, the reduction of the high-temperature strength can be suppressed, and the occurrence of cracks during casting can be readily suppressed. Since the magnesium alloy member contains the magnesium alloy that is hardly reduced in the high-temperature strength, the magnesium alloy member is unlikely to crack during casting even when it has a large thickness variation and has a complicated shape that includes a base part, and a plate part integrally molded with the base part.

(9) In an example of the magnesium alloy member, the precipitate further includes a $Mg_{17}Al_{12}$ phase, and the magnesium alloy member has, in a cross section, an area rate of the $Mg_{17}Al_{12}$ phase of less than or equal to 5%.

The $Mg_{17}Al_{12}$ phase reduces the high-temperature strength. Therefore, when the magnesium alloy has the $Mg_{17}Al_{12}$ phase, and has, in a cross section, an area rate of the $Mg_{17}Al_{12}$ phase of less than or equal to 5%, the reduction of the high-temperature strength can be suppressed, and the occurrence of cracks during casting can be readily suppressed. Since the magnesium alloy member contains the magnesium alloy that is hardly reduced in the high-temperature strength, the magnesium alloy member is unlikely to crack during casting even when it has a large thickness variation and has a complicated shape that includes a base part, and a plate part integrally molded with the base part.

[Details of Embodiments]

Details of the embodiments of the present disclosure will be described below.

<<Magnesium Alloy>>

The magnesium alloy according to an embodiment has a composition containing Al, Sr, Ca, and Mn, with the balance being Mg and inevitable impurities, and a structure having an α-Mg phase, and a precipitate dispersed in at least one of a grain boundary of the α-Mg phase and a cell boundary. One of characteristics of the magnesium alloy according to an embodiment is that the magnesium alloy includes specific precipitates each in a specific range. Hereinafter, first, the composition of the magnesium alloy will be described, and then the structure of the magnesium alloy will be described.

<Composition>

The magnesium alloy contains Al, Sr, Ca, and Mn, with the balance being Mg and inevitable impurities.

[Aluminum (Al)]

Al has a function of improving the high-temperature strength by forming a compound phase containing Sr or a compound phase containing Ca to be present as a precipitate in the alloy structure. Examples of the compound phase containing Al and Sr and contributing to the improvement of the high-temperature strength include an $Al_2Sr$ phase, an $Al_4Sr$ phase, a $(Mg, Al)_2Sr$ phase, and a $(Mg, Al)_4Sr$ phase (group A compound phase). Examples of the compound phase containing Al and Ca and contributing to the improvement of the high-temperature strength include an $Al_2Ca$ phase and a $(Mg, Al)_2Ca$ phase (group B compound phase). In order for the group A compound phase and the group B compound phase to be present as precipitates, the Al content may be greater than or equal to 6.5 mass %. When the Al content is greater than or equal to 6.5 mass %, the strength of a magnesium alloy matrix (α-Mg phase) can be improved. Further, when the Al content is greater than or equal to 6.5 mass %, the melting point of the magnesium alloy is lowered to improve the flowability of the molten metal, so that the castability is readily improved. The Al content may further be greater than or equal to 7.1 mass %, and may in particular be greater than or equal to 8.1 mass %.

Meanwhile, too high an Al content readily crystallizes a compound phase that reduces the high-temperature strength. Examples of the compound phase that reduces the high-temperature strength include the $Mg_{17}Al_{12}$ phase. Therefore, the Al content may be less than or equal to 13.1 mass %. The Al content may further be less than or equal to 12.6 mass %, and may in particular be less than or equal to 10.1 mass %.

[Strontium (Sr)]

Sr has a function of improving the high-temperature strength by forming a group A compound phase such as an $Al_2Sr$ phase, an $Al_4Sr$ phase, a $(Mg, Al)_2Sr$ phase, and/or a $(Mg, Al)_4Sr$ phase to be present as a precipitate in the alloy structure. Sr also has a function of suppressing the formation of a compound phase that reduces the high-temperature strength, such as the $Mg_{17}Al_{12}$ phase, by forming the group A compound phase to be present as a precipitate. In order for the group A compound phase to be present as a precipitate, the Sr content may be greater than or equal to 1.6 mass %. The higher the Sr content is, the more sufficiently the group A compound phase is formed to be more abundantly present as a precipitate in a grain boundary and/or a cell boundary, and the grain boundary sliding and the like can be readily suppressed. The Sr content may further be greater than or equal to 2.6 mass %, and may in particular be greater than or equal to 2.8 mass %.

Meanwhile, too high a Sr content allows for excessive presence of the group A compound phase as a precipitate, and further a compound phase that reduces the high-temperature strength is readily crystallized. Examples of the compound phase that reduces the high-temperature strength include an $Al_{17}Sr_8$ phase and a $Mg_{17}Sr_2$ phase (group C compound phases) and the $Mg_{17}Al_{12}$ phase. Therefore, the Sr content may be less than or equal to 3.9 mass %. When the Sr content is less than or equal to 3.9 mass %, seizure to a casting mold during casting can be readily suppressed. The Sr content may further be less than or equal to 3.6 mass %, and may in particular be less than or equal to 3.4 mass %.

[Calcium (Ca)]

Ca has a function of improving the high-temperature strength by forming a group B compound phase such as an $Al_2Ca$ phase and/or a $(Mg, Al)_2Ca$ phase to be present as a precipitate in the alloy structure. Ca also has a function of suppressing the formation of a compound phase that reduces the high-temperature strength, such as the $Mg_{17}Al_{12}$ phase, by forming the group B compound phase to be present as a precipitate. In order for the group B compound phase to be present as a precipitate, the Ca content may be greater than or equal to 0.3 mass %. The higher the Ca content is, the more sufficiently the group B compound phase is formed to be more abundantly present as a precipitate in a grain boundary and/or a cell boundary, and the grain boundary sliding and the like can be readily suppressed. The Ca content may further be greater than or equal to 0.6 mass %, and may in particular be greater than or equal to 0.8 mass %.

Meanwhile, too high a Ca content allows for excessive presence of the group B compound phase as a precipitate, and the $Mg_{17}Al_{12}$ phase is readily crystallized. Therefore, the Ca content may be less than or equal to 2.4 mass %. When the Ca content is less than or equal to 2.4 mass %, excessive presence of the group B compound phase as a precipitate, which may cause defects such as hot cracks, can be readily suppressed. The Ca content may further be less than or equal to 1.8 mass %, and may in particular be less than or equal to 1.5 mass %.

[Manganese (Mn)]

Mn has a function of suppressing the crystallization of a compound phase that reduces the high-temperature strength, such as the $Mg_{17}Al_{12}$ phase, by forming a compound phase containing Al to be present as a precipitate in the alloy structure. Mn also contributes to the improvement of corrosion resistance by reducing Fe that may be present as impurities in the magnesium alloy. The Mn content may be greater than or equal to 0.02 mass % and less than or equal to 0.50 mass %, may further be greater than or equal to 0.10 mass % and less than or equal to 0.45 mass %, and may in particular be greater than or equal to 0.20 mass % and less than or equal to 0.38 mass %.

[Sr/Al]

In addition to the contents of Sr and Al satisfying the above-mentioned ranges, the ratio of the Sr content to the Al content (Sr/Al) may satisfy the range of greater than or equal to 0.23 and less than or equal to 0.55. Since the above-mentioned ratio satisfies the range of greater than or equal to 0.23, the group A compound phase such as the $Al_2Sr$ phase, the $Al_4Sr$ phase, the $(Mg, Al)_2Sr$ phase, and/or the $(Mg, Al)_4Sr$ phase can be present in a specific range as a precipitate in the alloy structure, and the high-temperature strength can be improved. If the above-mentioned ratio is too large, the Sr content is too high relative to the Al content, so that Sr cannot be consumed and a compound phase that reduces the high-temperature strength, such as the $Mg_{17}Al_{12}$ phase, is formed. Therefore, since the ratio is less than or equal to 0.55, the formation of the $Mg_{17}Al_{12}$ phase can be suppressed, and the reduction of the high-temperature strength can be suppressed. The ratio of the Sr content to the Al content may further be greater than or equal to 0.25 and less than or equal to 0.46, and may in particular be greater than or equal to 0.27 and less than or equal to 0.39.

[Sr+Ca]

In addition to the contents of Sr and Ca satisfying the above-mentioned ranges, the total content of Sr and Ca (Sr+Ca) may satisfy the range of greater than or equal to 3 mass % and less than or equal to 5.5 mass %. A total content satisfying the range of greater than or equal to 3 mass % can readily improve the high-temperature strength. Meanwhile, a total content satisfying the range of less than or equal to 5.5 mass % can readily suppress defects such as seizure to a casting mold and hot cracks effectively. The total content of Sr and Ca may further be greater than or equal to 3.3 mass % and less than or equal to 5.3 mass %, and may in particular be greater than or equal to 3.5 mass % and less than or equal to 5.0 mass %.

The content ratio of Sr to Ca may be 1.5:1 to 5:1. Since the content ratio of Sr to Ca satisfies the above-mentioned range, the effect of improving the high-temperature strength and the effect of suppressing defects such as seizure to a casting mold and hot cracks can be readily obtained in a well-balanced manner. The content ratio of Sr to Ca may further be 2.1:1 to 4.2:1.

[Other Elements]

Examples of elements that do not inhibit the above-mentioned effects include Bi (bismuth), Zn (zinc), Si (silicon), Sn (tin), and rare earth elements (i.e., Sc, Y, La, Ce, Pr, Nd, Pm, Sm, Eu, Gd, Tb, Dy, Ho, Er, Tm, Yb, and Lu). Each of these elements in an amount of less than or equal to 2 mass % provides the same effects as those described above.

[Inevitable Impurities]

The magnesium alloy may contain, as impurities, at least one element selected from iron (Fe), nickel (Ni), copper (Cu), and silicon (Si). Since these elements tend to lower the corrosion resistance, the contents of these elements are preferably small. The Fe content may be less than or equal to 50 ppm on a mass basis. The Ni content may be less than or equal to 200 ppm on a mass basis. The Cu content may be less than or equal to 300 ppm on a mass basis. The Si content may be less than or equal to 1000 ppm on a mass basis. The elements specified here are regarded as inevitable impurities when satisfying the above-mentioned contents.

<Structure>

The magnesium alloy has a structure having an α-Mg phase (Mg crystal grains), and a precipitate dispersed in at least one of a grain boundary of the α-Mg phase and a cell boundary. FIG. 1 shows a schematic view of the structure of the magnesium alloy. In FIG. 1, the α-Mg phase is indicated by downward-sloping diagonal hatching, and the precipitate is indicated by outline partially including elliptical shapes. The "grain boundary of the α-Mg phase" is an interface where crystals of a parent phase (α-Mg phase) growing in different crystal orientations are in contact with each other, and is indicated by thick dotted lines in FIG. 1. The "cell boundary" is an interface formed by a difference in the composition, and is indicated by thick solid lines in FIG. 1. As shown in FIG. 1, the precipitates are present in a dispersed state in the grain boundary of the α-Mg phase and/or the cell boundary. Although the precipitates are schematically shown in elliptical shapes in FIG. 1, the precipitates are actually present in lamellar shapes, grain shapes, elongated shapes, and/or lump shapes.

The precipitate includes at least one phase selected from a group A consisting of an $Al_2Sr$ phase, an $Al_4Sr$ phase, a $(Mg, Al)_2Sr$ phase, and a $(Mg, Al)_4Sr$ phase, and at least one phase selected from a group B consisting of an $Al_2Ca$ phase and a $(Mg, Al)_2Ca$ phase. The precipitate may further include at least one phase selected from a group C consisting of an $Al_{17}Sr_8$ phase and a $Mg_{17}Sr_2$ phase, and/or a $Mg_{17}Al_{12}$ phase. One of characteristics of the magnesium alloy according to an embodiment is that the magnesium alloy has a structure in which the group A precipitate and the group B precipitate are present in a relatively large amount in a specific range, and the group C precipitate and the $Mg_{17}Al_{12}$ phase are present each in a relatively small amount or are substantially absent.

[Group a Precipitate]

The group A precipitate includes at least one phase selected from the $Al_2Sr$ phase, the $Al_4Sr$ phase, the $(Mg, Al)_2Sr$ phase, and the $(Mg, Al)_4Sr$ phase. The group A precipitate has a function of improving the high-temperature strength. The group A precipitate has a melting point of greater than or equal to 1000° C., which is sufficiently higher than the melting points of the group C precipitate and the $Mg_{17}Al_{12}$ phase. Therefore, since the group A precipitate is present in a dispersed state in the grain boundary of the α-Mg phase and/or the cell boundary, the magnesium alloy can maintain the strength even at high temperatures, and is unlikely to crack during casting. The group A precipitate is typically present in a lamellar shape or an elongated shape.

[Group B Precipitate]

The group B precipitate includes at least one phase selected from the $Al_2Ca$ phase and the $(Mg, Al)_2Ca$ phase. The group B precipitate has a function of improving the high-temperature strength. The group B precipitate has a melting point of greater than or equal to 1000° C., which is sufficiently higher than the melting points of the group C precipitate and the $Mg_{17}Al_{12}$ phase. Therefore, since the group B precipitate is present in a dispersed state in the grain boundary of the α-Mg phase and/or the cell boundary, the magnesium alloy can maintain the strength even at high temperatures, and is unlikely to crack during casting. The group B precipitate is typically present in a lamellar shape or an elongated shape.

[Total of Group a Precipitate and Group B Precipitate]

The total area rate of the group A precipitate and the group B precipitate in a cross section of the magnesium alloy is greater than or equal to 2.5% and less than or equal to 30%. Since the area rate is greater than or equal to 2.5%, the magnesium alloy can exhibit practically sufficient high-temperature strength, and is unlikely to crack during casting. The larger the area rate is, the more the high-temperature strength can be improved. Therefore, the area rate may further be greater than or equal to 10%, and may in particular be greater than or equal to 15%. Meanwhile, too large an area rate tends to allow for the presence of precipitates that reduce the high-temperature strength. Therefore, the area rate may further be less than or equal to 27%, and may in particular be less than or equal to 25%.

When a precipitate that reduces the high-temperature strength is present, specifically, when the group C precipitate and/or the $Mg_{17}Al_{12}$ phase is present as the precipitate, the area rate may be greater than or equal to 10% and less than or equal to 25%. When the area rate is greater than or equal to 10%, the reduction of the high-temperature strength can be readily suppressed, and the occurrence of cracks during casting can be readily suppressed even when the area rate of the group C precipitate or the $Mg_{17}Al_{12}$ phase is large. Meanwhile, when the area rate is less than or equal to 25%, the crystallization of the group C precipitate can be readily suppressed. In particular, when both the group C precipitate and the $Mg_{17}Al_{12}$ phase are present as precipitates that reduce the high-temperature strength, the area rate may be greater than or equal to 15% and less than or equal to 25%.

[Group C Precipitate]

The group C precipitate includes at least one phase selected from the $Al_{17}Sr_8$ phase and the $Mg_{17}Sr_2$ phase. The group C precipitate reduces the high-temperature strength. Therefore, when the magnesium alloy has the group C precipitate as a precipitate, the area rate of the group C precipitate in a cross section may be less than or equal to 15%. In particular, when both the group C precipitate and the $Mg_{17}Al_{12}$ phase are present as precipitates that reduce the high-temperature strength, the area rate of the group C precipitate may be less than or equal to 7%. The smaller the amount of the group C precipitate is, the more the reduction of the high-temperature strength can be suppressed. Therefore, the area rate of the group C precipitate may further be less than or equal to 5.5%, and may in particular be less than or equal to 4.5%, and it is preferable that the group C precipitate be substantially absent. The group C precipitate is typically present in a lump shape.

Further, in order to suppress the reduction of the high-temperature strength and suppress the cracks of the magnesium alloy member during casting, the area rate of the group C precipitate in a cross section may preferably be less than or equal to 10%. In particular, when both the group C precipitate and the $Mg_{17}Al_{12}$ phase are present as precipitates that reduce the high-temperature strength, the area rate of the group C precipitate may preferably be less than or equal to 7%. The smaller the amount of the group C precipitate is, the more the reduction of the high-temperature strength can be suppressed, and the more the cracks of the magnesium alloy member during casting can be suppressed. Therefore, the area rate of the group C precipitate may further be less than or equal to 5.5%, may in particular preferably be less than or equal to 4.5%, and it is most preferable that the group C precipitate be substantially absent.

[$Mg_{17}Al_{12}$ Phase]

The $Mg_{17}Al_{12}$ phase reduces the high-temperature strength. Therefore, when the magnesium alloy has the $Mg_{17}Al_{12}$ phase as a precipitate, the area rate of the $Mg_{17}Al_{12}$ phase in a cross section may be less than or equal to 10%. In particular, when both the group C precipitate and the $Mg_{17}Al_{12}$ phase are present as precipitates that reduce the high-temperature strength, the area rate of the $Mg_{17}Al_{12}$ phase may be less than or equal to 5%. The smaller the amount of the $Mg_{17}Al_{12}$ phase is, the more the reduction of the high-temperature strength can be suppressed. Therefore, the area rate of the $Mg_{17}Al_{12}$ phase may further be less than or equal to 3.5%, and may in particular be less than or equal to 2.5% or less, and it is preferable that the $Mg_{17}Al_{12}$ phase be substantially absent. The $Mg_{17}Al_{12}$ phase is typically present in a grain shape.

Further, in order to suppress the reduction of the high-temperature strength and suppress the cracks of the magnesium alloy member during casting, the area rate of the $Mg_{17}Al_{12}$ phase in a cross section may preferably be less than or equal to 5%. In particular, when both the group C precipitate and the $Mg_{17}Al_{12}$ phase are present as precipitates that reduce the high-temperature strength, the area rate of the $Mg_{17}Al_{12}$ phase may preferably be less than or equal to 3%. The smaller the amount of the $Mg_{17}Al_{12}$ phase is, the more the reduction of the high-temperature strength can be suppressed, and the more the cracks of the magnesium alloy member during casting can be suppressed. Therefore, the area rate of the $Mg_{17}Al_{12}$ phase may further preferably be less than or equal to 2.5%, and it is most preferable that the $Mg_{17}Al_{12}$ phase be substantially absent.

The composition of each of the precipitates described above can be confirmed by component analysis based on, for example, energy dispersive X-ray spectroscopy (EDX), X-ray diffractometry (XRD), and Auger electron spectroscopy (AES).

As for each of the precipitates described above, the area rate in a cross section of the magnesium alloy can be measured as follows. First, using a micrograph of a cross section of the magnesium alloy, the precipitates present in the observation field of view Sf are individually extracted as for the total of the group A precipitate and the group B precipitate, the group C precipitate, and the $Mg_{17}Al_{12}$ phase, the areas of the extracted precipitates are determined, and the total areas Sm of the individually extracted precipitates are further determined. Then, the ratio obtained by dividing the total area of the group A precipitate and the group B precipitate, $Sm_{A+B}$, by the area of the observation field of view Sf ($(Sm_{A+B}/Sf)\times100\%$) is determined as the total area rate of the group A precipitate and the group B precipitate. Similarly, the ratio obtained by dividing the total area of the group C precipitate, $Sm_C$, by the area of the observation field of view Sf ($(Sm_C/Sf)\times100\%$) is determined as the area rate of the group C precipitate. The ratio obtained by dividing the total area of the $Mg_{17}Al_{12}$ phase, $Sm_D$, by the area of the observation field of view Sf ($(Sm_D/Sf)\times100\%$) is determined as the area rate of the $Mg_{17}Al_{12}$ phase. The number of observation fields of view may be greater than or equal to five, and may further be greater than or equal to ten. In this case, the area rate of each precipitate is the average for the number of observation fields of view. The cross section can be sampled using a commercially available cross section polisher (CP) processing device. The cross-sectional area of each precipitate can be readily measured using a binarized image obtained by binarizing a micrograph (SEM image) with an image processing apparatus. The SEM image can be binarized by differentiating a precipitate to be measured (for example, the group A precipitate and the group B precipitate) from the α-Mg phase and precipitates other than the precipitate to be measured (for example, the group C precipitate and the $Mg_{17}Al_{12}$ phase) by a difference in brightness. In this case, the type of the α-Mg phase and each precipitate can be confirmed by a point analysis based on EDX.

<<Method for Producing Magnesium Alloy>>

The above-mentioned magnesium alloy can typically be produced by preparing a melt of the magnesium alloy having the above-mentioned composition and casting the melt.

The magnesium alloy melt may be prepared as follows. As raw materials, a lump of pure magnesium having a purity greater than or equal to 99 mass %, preferably greater than or equal to 99.5 mass %, and lumps of elemental metals to be added or a lump of an alloy of elements to be added are used.

First, using the prepared raw material lump, pure magnesium is completely melted to prepare a pure magnesium melt. When the atmospheric gas is a rare gas such as an argon (Ar) gas or an inert gas such as a nitrogen gas or a $CO_2$ gas, oxidation of Mg or the like can be suppressed. In addition, when the atmospheric gas contains a fireproof gas such as $SF_6$, ignition can be prevented.

To the pure magnesium melt, the elements to be added including Al, Sr, Ca, and Mn are added. At the time of addition of the elements to be added, Al may be added first because Al tends to lower the activity of Mg. In addition, Ca may be added last because Ca is easily soluble in pure magnesium. Mn may be added simultaneously with Al since Mn takes a relatively long time to dissolve.

During the addition of the elements to be added, the pure magnesium melt is adjusted to a temperature greater than or equal to 680° C. and less than or equal to 730° C. The pure magnesium melt having a temperature greater than or equal to 680° C. can completely dissolve the elements to be added. The higher the temperature of the pure magnesium melt is, the more certainly the failure of dissolution of the elements to be added can be prevented, and the more the dissolution time can be shortened. Therefore, the temperature may be set to greater than or equal to 690° C., may further be set to greater than or equal to 700° C., and may in particular be set to greater than or equal to 710° C. Meanwhile, the pure magnesium melt having a temperature less than or equal to 730° C. can readily suppress the oxidation of Mg, and can readily prevent, when an iron crucible is used, the incorporation of Fe due to the elution of Fe. Therefore, the temperature may further be less than or equal to 720° C.

After the addition of the elements to be added, the resulting mixture is sufficiently stirred. The mixture is mechanically stirred using a rod-shaped jig or a commercially available stirrer. The stirring time depends on the stirring method, the amount of melt, and the like. When the stirring time is, for example, greater than or equal to about 5 minutes and less than or equal to about 15 minutes, a melt having a uniform component can be obtained. After stirring, the mixture can be left standing for greater than or equal to about 10 minutes and less than or equal to about 30 minutes to separate inclusions of the melt, and then the mixture can be immediately cast to prevent the separation (precipitation or suspension) of the added elements, and the group A crystallized product and the group B crystallized product can be properly produced.

The cooling rate in the casting process may be greater than or equal to 0.01° C./sec and less than or equal to 500° C./sec. The higher the cooling rate is, the more properly the group A crystallized product and the group B crystallized product can be produced. Therefore, the cooling rate may be greater than or equal to 100° C./sec, may further be 300° C./sec, and may in particular be 400° C./sec. The cooling conditions are preferably appropriately adjusted so as to achieve the above-mentioned cooling rate.

The precipitates include stable phases and metastable phases. The stable phases include the $Al_2Sr$ phase, the $Al_4Sr$ phase, the $Al_2Ca$ phase, the $Al_{17}Sr_8$ phase, and the $Mg_{17}Al_{12}$ phase. The metastable phases include the $(Mg, Al)_2Sr$ phase, the $(Mg, Al)_4Sr$ phase, the $(Mg, Al)_2Ca$ phase, and the $Mg_{17}Sr_2$ phase. The lower the cooling rate is, that is, the more slowly the mixture is solidified, the more the stable precipitates increase, whereas the higher the cooling rate is, that is, the more rapidly the mixture is solidified, the more the metastable precipitates increase.

In the cooling process, the compound phases are sequentially crystallized. For example, when the temperature is lowered from a temperature greater than or equal to 680° C. to a temperature less than or equal to 560° C. at a cooling rate of 0.01° C./sec to 50° C./sec, a large amount of multi-component eutectic crystals of the $Al_2Sr$ phase, the $Al_4Sr$ phase, and the $Al_2Ca$ phase are generated, and depending on the composition, at least one of the $Mg_{17}Al_{12}$ phase and the $Al_{17}Sr_8$ phase may be crystallized in a large amount in a lower temperature region than the temperature at which the multi-component eutectic crystals are generated. Moreover, when the temperature is lowered from a temperature greater than or equal to 680° C. to a temperature less than or equal to 560° C. at a cooling rate of greater than or equal to 300° C./sec, a large amount of multi-component eutectic crystals of the $(Mg, Al)_2Sr$ phase, the $(Mg, Al)_4Sr$ phase, and the $(Mg, Al)_2Ca$ phase are generated, and depending on the composition, at least one of the $Mg_{17}Al_{12}$ phase and the $Mg_{17}Sr_2$ phase may be crystallized in a large amount in a lower temperature region than the temperature at which the multi-component eutectic crystals are generated. Further, when the temperature is lowered from a temperature greater than or equal to 680° C. to a temperature less than or equal to 560° C. at a cooling rate of 50° C./sec to 300° C./sec, two or more multi-component eutectic crystals selected from the $Al_2Sr$ phase, the $Al_4Sr$ phase, the $Al_2Ca$ phase, the $(Mg, Al)_2Sr$ phase, the $(Mg, Al)_4Sr$ phase, and the $(Mg, Al)_2Ca$ phase are generated in a large amount, and depending on the composition, at least one of the $Mg_{17}Al_{12}$ phase, the $Al_{17}Sr_8$ phase, and the $Mg_{17}Sr_2$ phase may be crystallized in a large amount in a lower temperature region than the temperature at which the multi-component eutectic crystals are generated. In the cooling process, the mixture is cooled at a substantially uniform cooling rate from a temperature greater than or equal to 680° C. until the mixture is completely solidified.

<<Application>>

The magnesium alloy according to an embodiment can be suitably used as a material of various cast members.

<<Magnesium Alloy Member>>

The magnesium alloy member according to an embodiment contains the above-mentioned magnesium alloy, and includes a base part, and a plate part integrally molded with the base part to protrude from the base part. One of characteristics of the magnesium alloy member according to an embodiment is that the magnesium alloy member contains a magnesium alloy having precipitates contributing to the improvement of the high-temperature strength in a specific range, and that the magnesium alloy member has a portion having a large thickness variation. The "portion having a large thickness variation" is a boundary between the plate part and the base part having a length greater than or equal to five times the thickness of the plate part. The "base part having a length greater than or equal to five times the thickness of the plate part" has a thickness in a protruding direction of the plate part of greater than or equal to five times the thickness of the plate part. Further, the base part has a length in a direction intersecting with the protruding direction of the plate part of greater than or equal to five times the thickness of the plate part.

<Shape>

Figure 2A:
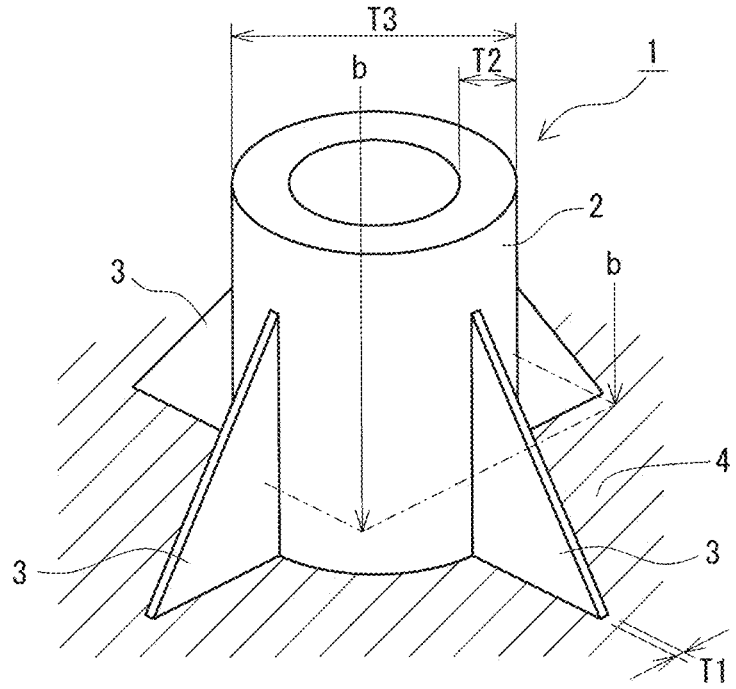
FIG. 2A is a conceptual perspective view showing a magnesium alloy member.
Figure 2B:
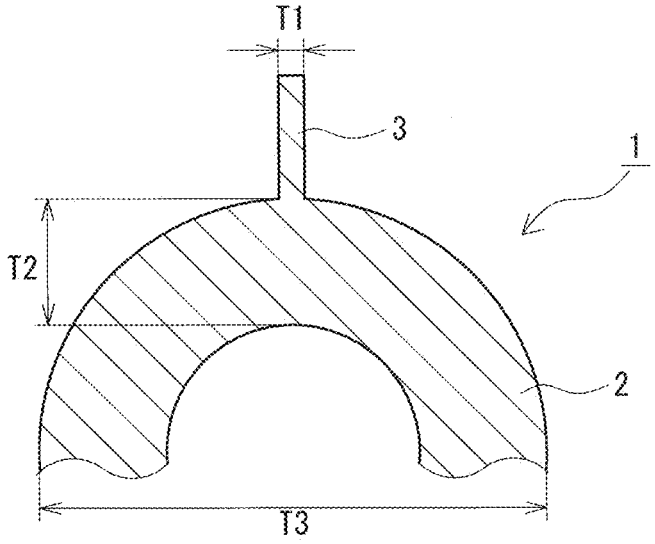
FIG. 2B is a cross-sectional view taken along line b-b of FIG. 2A.

FIGS. 2A and 2B schematically show a magnesium alloy member 1 having a boss 2 as the base part and ribs 3 as the plate part. Boss 2 and ribs 3 are integrally molded together to form an integrally molded article. FIG. 2A is a perspective view of magnesium alloy member 1, and FIG. 2B is a cross-sectional view taken along line b-b of FIG. 2A. In FIGS. 2A and 2B, each boundary between boss 2 and rib 3 is shown to have a corner for ease of understanding, but the configuration may differ from actual cases.

Boss 2 is provided to protrude from a pedestal 4. Boss 2 forms a female screw for a bolt or a screw to fix or connect magnesium alloy member 1 to another component, or forms an insertion hole for press-fitting a pin or the like, and is typically cylindrical.

Ribs 3 are provided to protrude from both pedestal 4 and boss 2 so as to connect pedestal 4 and boss 2 together. Ribs 3 reinforce boss 2, and each have a plate shape. Ribs 3 are provided radially on the outer periphery of boss 2. In this example, four ribs 3 are provided circumferentially evenly on boss 2. The positions and number of ribs 3 can be appropriately selected.

<Size>

Boss 2 and rib 3 are different in thickness. Specifically, boss 2 has a thickness T2 in the protruding direction of rib 3 of greater than or equal to five times a thickness T1 of rib 3. In general, rib 3 is provided on boss 2 perpendicularly to the surface of boss 2. Therefore, thickness T2 of boss 2 in the protruding direction of rib 3 is the thickness of boss 2 in the radial direction of boss 2, more specifically, the difference between the inner diameter and the outer diameter of boss 2. Such an integrally molded article having a shape large in difference in thickness between boss 2 and rib 3 is likely to crack at the boundary between boss 2 and rib 3 during casting. The larger the difference in thickness between boss 2 and rib 3 is, the more likely it is for the integrally molded article to crack at the boundary between boss 2 and rib 3 during casting. Although the details will be described later, magnesium alloy member 1 according to an embodiment is unlikely to crack during casting even when the difference in thickness between boss 2 and rib 3 is large. Therefore, in magnesium alloy member 1 according to an embodiment, thickness T2 of boss 2 in the protruding direction of rib 3 can further be set to be greater than or equal to six times, greater than or equal to seven times, or greater than or equal to eight times thickness T1 of rib 3. Too large a difference in thickness between boss 2 and rib 3, however, may cause cracks during casting. Therefore, thickness T2 of boss 2 in the protruding direction of rib 3 is preferably less than 15 times, less than or equal to 13 times, or less than or equal to 12 times thickness T1 of rib 3.

The thickness of rib 3 may be uniform in the protruding direction of rib 3 (FIG. 2A), or may decrease from boss 2 side toward the edge side of rib 3. Examples of the shape in which the thickness of rib 3 decreases from boss 2 side toward the edge side of rib 3 include a tapered shape, a curved shape in which the thickness decreases toward the edge side, a stepped shape, and a combination thereof. When the thickness of rib 3 decreases from boss 2 side toward the edge side, thickness T1 of rib 3 is defined by the following (A) or (B). (A) Thickness T1 of rib 3 is the largest thickness on boss 2 side. (B) Thickness T1 of rib 3 is the average thickness of the largest thickness on boss 2 side and the smallest thickness on the edge side.

Moreover, boss 2 has a length T3 in a direction intersecting with the protruding direction of rib 3 of greater than or equal to five times thickness T1 of rib 3. In general, rib 3 is provided on boss 2 perpendicularly to the surface of boss 2. More specifically, boss 2 has length T3 in a direction orthogonal to the protruding direction of rib 3 of greater than or equal to five times thickness T1 of rib 3. When the base part is cylindrical as shown by boss 2, length T3 of boss 2 in the direction intersecting with (orthogonal to) the protruding direction of rib 3 is the outer diameter of boss 2. An integrally molded article having a shape large in difference between thickness T1 of rib 3 and thickness T2 of boss 2 in the protruding direction of rib 3, and is further large in difference between thickness T1 of rib 3 and length T3 of boss 2 in the direction intersecting with the protruding direction of rib 3 is more likely to crack at the boundary between boss 2 and rib 3 during casting. Magnesium alloy member 1 according to an embodiment is unlikely to crack during casting even when it has such a shape that is likely to cause cracks. Therefore, in magnesium alloy member 1 according to an embodiment, length T3 of boss 2 in the direction intersecting with the protruding direction of rib 3 can further be set to be greater than or equal to six times, greater than or equal to seven times, or greater than or equal to eight times thickness T1 of rib 3. Too large a difference between thickness T1 of rib 3 and length T3 of boss 2 in the direction intersecting with the protruding direction of rib 3, however, may cause cracks during casting. Therefore, length T3 of boss 2 in the direction intersecting with the protruding direction of rib 3 is preferably less than 15 times, less than or equal to 13 times, or less than or equal to 12 times thickness T1 of rib 3.

Examples of the magnesium alloy member having a portion having a large thickness variation include, in addition to magnesium alloy member 1 including boss 2 and rib 3, the following forms. One example is a magnesium alloy member including a container-shaped main body opened at one end, a flange extending outward from a verge of the opening of the main body, and a rib for reinforcing the flange. The main body has a bottom and a side wall. The rib is provided to protrude from both the side wall and the flange so as to connect the side wall and the flange. In this magnesium alloy member, the side wall or the flange is a base part, the rib is a plate part, and the thickness of the side wall or the flange is greater than or equal to five times the thickness of the rib. Another example is a magnesium alloy member including a container-shaped main body opened at one end, and a rib for reinforcing the corner of the main body. The main body has a bottom and a side wall. The rib is provided to protrude from both the bottom and the side wall so as to connect the bottom and the side wall. In this magnesium alloy member, the side wall or the bottom is a base part, the rib is a plate part, and the thickness of the side wall or the bottom is greater than or equal to five times the thickness of the rib.

Test Example 1

Each magnesium alloy member was produced using a magnesium alloy, and the magnesium alloy member was subjected to cross-sectional observation and heat resistance evaluation.

[Preparation of Samples]

As a raw material, a 50 kg lump of pure magnesium having a purity of 99.9 mass % was prepared and melted at 690° C. using a melting furnace in an Ar atmosphere to prepare a pure magnesium melt. To the completely melted pure magnesium melt, lumps of the following elements 1 to 4 to be added were added to prepare magnesium alloy melts each having the composition shown in Table 1. The elements to be added were added and dissolved by stirring for 10 minutes with a rod-shaped jig in a state where the temperature of the melt was held at 690° C.

1. A pure aluminum lump having a purity of 99.9 mass %
2. A Sr lump having a purity of 99 mass %
3. A Ca lump having a purity of 99.5 mass %
4. An aluminum mother alloy (Al—10 mass % Mn)

A magnesium alloy member was produced using each of the prepared magnesium alloy melt samples. For the production of the magnesium alloy member, a cold chamber die casting machine (model number UB530iS2, manufactured by UBE MACHINERY CORPORATION, Ltd.) was used. The cooling rates in the casting process are collectively shown in Table 1. The magnesium alloy members had a ring shape.

[Cross-Sectional Observation]

A cross section of each of the produced magnesium alloy member samples was sampled, and the structure of the sample was observed with a scanning electron microscope (SEM). The cross section was sampled using a commercially available cross section polisher (CP) processing device. An arbitrary observation field of view was sampled in the CP cross section.

The area rate of individual precipitate or phases was determined using the SEM micrograph. Specifically, the precipitates present in the observation field of view Sf (350 μm×250 μm) were individually extracted as for the total of the group A precipitate and the group B precipitate, the group C precipitate, and the $Mg_{17}Al_{12}$ phase, the total areas Sm of the individually extracted precipitates were determined, and the values of (Sm/Sf)×100% were determined as the area rates of the individually extracted precipitates in the cross section. In this example, the number of observation fields of view was ten, and the average of area rates in the ten observation fields of view was defined as the area rate (%) of the individually extracted precipitate or phases in each sample. The results are collectively shown in Table 1. In Table 1, "group A+group B" is the total area rate of the group A precipitate and the group B precipitate, and "group C" is the area rate of the group C precipitate. The group A precipitate includes at least one phase selected from the $Al_2Sr$ phase, the $Al_4Sr$ phase, the $(Mg, Al)_2Sr$ phase, and the $(Mg, Al)_4Sr$ phase. The group B precipitate includes at least one phase selected from the $Al_2Ca$ phase and the $(Mg, Al)_2Ca$ phase. The group C precipitate includes at least one phase selected from the $Al_{17}Sr_8$ phase and the $Mg_{17}Sr_2$ phase. The cross-sectional area of each precipitate can be readily measured using a binarized image obtained by binarizing a micrograph (SEM micrograph) with an image processing apparatus.

[Evaluation of Heat Resistance]

Residual Axial Force

The residual axial force of each of the produced magnesium alloy member samples was measured. Specifically, each of the magnesium alloy member samples and an aluminum block material were fastened together with an iron bolt to produce a test member, the test member was subjected to heat treatment, and the residual axial force (%) was determined from the amount of strain of the bolt before and after the heat treatment. The test member was produced by providing, in an appropriate position of the block material, a bolt hole having the same diameter as that of the hole in the magnesium alloy member sample, aligning the bolt hole with the hole in the magnesium alloy member sample, and tightening the iron bolt for fastening. The conditions of the heat treatment were a temperature of 150° C. and a holding time of 170 hours. The amount of strain was determined using a commercially available strain gauge installed on the bolt. The residual axial force was calculated from [(St−So)/So]×100(%), where So is the amount of strain of the bolt immediately after fastening and before heating to 150° C., and St is the amount of strain of the bolt after being subjected to the thermal history of 150° C.×170 hours. The amount of strain So before heating was the amount of strain after the bolt was tightened with an initial tightening axial force of 9 N. The results of the residual axial force and evaluations A to C of the residual axial force are collectively shown in Table 1. In the evaluation A, the residual axial force was greater than or equal to 60%, in the evaluation B, the residual axial force was greater than or equal to 50% and less than 60%, and in the evaluation C, the residual axial force was less than 50%.

Proof Stress at 150° C.

The proof stress at 150° C. of each of the produced magnesium alloy member samples was measured. Specifically, a test piece was collected from each of the magnesium alloy member samples, and the test piece was subjected to a tensile test at 150° C. to measure the 0.2% proof stress. The 0.2% proof stress was measured using a universal tensile tester in accordance with JIS Z 2241 (2011) "Metallic materials-Tensile testing". The results of the proof stress at 150° C. and evaluations A to D of the proof stress at 150° C. are collectively shown in Table 1. In the evaluation A, the proof stress at 150° C. was greater than or equal to 140 MPa, in the evaluation B, the proof stress at 150° C. was greater than or equal to 130 MPa and less than 140 MPa, in the evaluation C, the proof stress at 150° C. was greater than or equal to 120 MPa and less than 130 MPa, and in the evaluation D, the proof stress at 150° C. was less than 120 MPa. The notation "-" in Table 1 indicates that the elongation in the tensile test was extremely low so that it was impossible to measure the 0.2% proof stress.

TABLE 1

| Sample No. | Cooling rate (° C./sec) | Alloy composition Al (mass %) | Sr (mass %) | Ca (mass %) | Mn (mass %) | Sr + Ca (mass %) | Sr/Al | Area rate of precipitate group A + group B (%) | group C (%) | $Mg_{17}Al_{12}$ phase (%) | Residual axial force (%) | Evaluation | Proof stress at 150° C. (MPa) | Evaluation |
|---|---|---|---|---|---|---|---|---|---|---|---|---|---|---|
| 1-1 | 400 | 9.2 | 3.2 | 1.1 | 0.25 | 4.3 | 0.35 | 21 | 0 | 0 | 60 | A | 141 | A |
| 1-2 | to | 8.6 | 3.4 | 1.3 | 0.25 | 4.7 | 0.40 | 25 | 0 | 0 | 65 | A | 145 | A |
| 1-3 | 500 | 9.5 | 3.5 | 1.5 | 0.24 | 5.0 | 0.37 | 29 | 1 | 0 | 68 | A | 150 | A |
| 1-4 | | 7.4 | 2.8 | 0.6 | 0.26 | 3.4 | 0.38 | 14 | 0 | 0 | 61 | A | 138 | B |
| 1-5 | | 8.1 | 2.7 | 0.8 | 0.25 | 3.5 | 0.33 | 12 | 0 | 0 | 62 | A | 135 | B |
| 1-6 | | 7.1 | 2.6 | 1.1 | 0.25 | 3.7 | 0.37 | 13 | 0 | 0 | 64 | A | 131 | B |
| 1-7 | | 9.8 | 2.8 | 0.7 | 0.24 | 3.5 | 0.29 | 11 | 0 | 0 | 54 | B | 133 | B |
| 1-8 | | 10.1 | 2.6 | 1.4 | 0.25 | 4.0 | 0.26 | 15 | 0 | 1 | 56 | B | 140 | A |
| 1-9 | | 9.9 | 3.5 | 0.6 | 0.25 | 4.1 | 0.35 | 14 | 0 | 0 | 52 | B | 132 | B |
| 1-11 | 100 | 7.5 | 2.7 | 0.8 | 0.24 | 3.5 | 0.36 | 16 | 0 | 0 | 60 | A | 130 | B |
| 1-12 | to | 8.1 | 3.2 | 1.2 | 0.23 | 4.4 | 0.40 | 18 | 0 | 0 | 64 | A | 138 | B |
| 1-13 | 200 | 10.3 | 2.4 | 0.9 | 0.26 | 3.3 | 0.23 | 15 | 0 | 4 | 56 | B | 135 | B |
| 1-14 | | 9.0 | 3.5 | 0.6 | 0.24 | 4.1 | 0.39 | 17 | 0 | 2 | 54 | B | 136 | B |
| 1-15 | | 10.1 | 2.6 | 1.5 | 0.25 | 4.1 | 0.26 | 19 | 0 | 0 | 65 | A | 145 | A |
| 1-16 | | 8.5 | 2.7 | 1.4 | 0.25 | 4.1 | 0.32 | 16 | 1 | 0 | 67 | A | 139 | B |
| 1-17 | | 9.6 | 3.8 | 1 | 0.27 | 4.8 | 0.40 | 18 | 0 | 0 | 68 | A | 143 | A |
| 1-18 | | 7.2 | 3.7 | 1.7 | 0.24 | 5.4 | 0.51 | 18 | 9 | 0 | 72 | A | 127 | C |
| 1-19 | | 10.2 | 2.8 | 0.6 | 0.25 | 3.4 | 0.27 | 15 | 0 | 7 | 50 | B | 121 | C |
| 1-101 | 400 | 4.5 | 4.9 | 2.8 | 0.24 | 7.7 | 1.09 | 32 | 18 | 0 | 63 | A | — | D |
| 1-102 | to | 8.1 | 3.3 | 0 | 0.26 | 3.3 | 0.41 | 8 | 0 | 13 | 25 | C | 96 | D |
| 1-103 | 500 | 9.3 | 0 | 0.9 | 0.23 | 0.9 | 0.00 | 2 | 0 | 15 | 23 | C | 92 | D |
| 1-111 | 100 | 4.6 | 3.8 | 1.2 | 0.26 | 5.0 | 0.83 | 7 | 16 | 0 | 58 | B | — | D |
| 1-112 | to | 8.3 | 3.2 | 0 | 0.25 | 3.2 | 0.39 | 7 | 0 | 11 | 29 | C | 94 | D |
| 1-113 | 200 | 9.5 | 0 | 0.7 | 0.23 | 0.7 | 0.00 | 4 | 0 | 14 | 23 | C | 90 | D |

As shown in Table 1, it is understood that Sample Nos. 1-1 to 1-9 and 1-11 to 1-19 satisfying the total area rate of the group A precipitate and the group B precipitate of greater than or equal to 10% and less than or equal to 30% have a high residual axial force and a high proof stress at 150° C. In particular, it is understood that Sample Nos. 1-1 to 1-9 and 1-11 to 1-17, in which the group C precipitate and the $Mg_{17}Al_{12}$ phase are absent or the area rates of these phases are small, have a very high proof stress at 150° C. of greater than or equal to 130 MPa. As for Sample No. 1-18, it seems that the sample has a low high-temperature strength and a low proof stress at 150° C. due to a relatively large area rate of the group C precipitate of 9% in spite of a large total area rate of the group A precipitate and the group B precipitate of 18%. Further, as for Sample No. 1-19, it seems that the sample has a low high-temperature strength and a low proof stress at 150° C. due to a relatively large area rate of the $Mg_{17}Al_{12}$ phase of 7% in spite of a large total area rate of the group A precipitate and the group B precipitate of 15%.

Meanwhile, it is understood that Sample Nos. 1-101 to 1-103 and 1-111 to 1-113, in which the group C precipitate and the $Mg_{17}Al_{12}$ phase are present in addition to the group A precipitate and the group B precipitate, and the area rates of the group C precipitate and the $Mg_{17}Al_{12}$ phase are large, have a very low proof stress at 150° C. of less than 100 MPa. As for Sample Nos. 1-101 and 1-111, it seems that the samples have a low high-temperature strength and a low proof stress at 150° C. due to too high a content of Sr relative to Al and the group C precipitate crystallized in a large amount. The reason why it was impossible to measure the 0.2% proof stress in Sample Nos. 1-101 and 1-111 is thought to be that the group A precipitate and the group B precipitate were present in lamellar shapes, whereas the group C precipitate was present in a lump shape, so that the elongation was extremely low. As for Sample Nos. 1-102 and 1-112, it seems that the samples have a low high-temperature strength and a low proof stress at 150° C. due to the absence of Ca and the small area rate of the group A precipitate and the group B precipitate, and the $Mg_{17}Al_{12}$ phase crystallized in a large amount. As for Sample Nos. 1-103 and 1-113, it seems that the samples have a low high-temperature strength and a low proof stress at 150° C. due to the absence of Sr and the small area rate of the group A precipitate and the group B precipitate, and the $Mg_{17}Al_{12}$ phase crystallized in a large amount.

Test Example 2

In Test Example 2, each magnesium alloy member was produced with the cooling rate in the casting process being slow cooling (1 to 50° C./sec). The magnesium alloy members were produced by gravity casting using a mold. In Test Example 2, the compositions of the magnesium alloys and the cooling rate in the casting process are different from those in Test Example 1, and the other test conditions are the same as in Test Example 1. The compositions of the magnesium alloys are shown in Table 2.

Each of the produced magnesium alloy member samples was subjected to cross-sectional observation of the magnesium alloy member and heat resistance evaluation in the same manner as in Test Example 1. In Test Example 2, since the cooling rate in the casting process is slow cooling, the mode of solidification approaches equilibrium solidification as compared with non-equilibrium solidification in rapid cooling. During non-equilibrium solidification, the crystallization of metastable phases increases. As the mode of solidification approaches equilibrium solidification, the crystallization of stable phases increases. As a result, when the cooling rate is slow cooling, the total area rate of the group A precipitate and the group B precipitate is small. Therefore, both the residual axial force and the proof stress at 150° C. are lower than those in Test Example 1. In Test Example 2, as for the evaluation of the residual axial force, in the evaluation A, the residual axial force was greater than or equal to 50%, in the evaluation B, the residual axial force was greater than or equal to 40% and less than 50%, and in the evaluation C, the residual axial force was less than 40%. In addition, as for the evaluation of the proof stress at 150° C., in the evaluation A, the proof stress at 150° C. was greater than or equal to 60 MPa, in the evaluation B, the proof stress at 150° C. was greater than or equal to 50 MPa and less than 60 MPa, in the evaluation C, the proof stress at 150° C. was greater than or equal to 30 MPa and less than 50 MPa, and in the evaluation D, the proof stress at 150° C. was less than 30 MPa. The results of the area rate of each precipitate, residual axial force, and proof stress at 150° C. are collectively shown in Table 2.

TABLE 2

| Sample No. | Cooling rate (° C./sec) | Alloy composition Al (mass %) | Sr (mass %) | Ca (mass %) | Mn (mass %) | Sr + Ca (mass %) | Sr/Al | Area rate of precipitate group A + group B (%) | group C (%) | $Mg_{17}Al_{12}$ phase (%) | Residual axial force (%) | Evaluation | Proof stress at 150° C. (MPa) | Evaluation |
|---|---|---|---|---|---|---|---|---|---|---|---|---|---|---|
| 2-1 | 1 to 50 | 7.3 | 2.8 | 0.6 | 0.25 | 3.4 | 0.38 | 4 | 0 | 2 | 52 | A | 58 | B |
| 2-2 | | 8.3 | 3.1 | 1 | 0.25 | 4.1 | 0.37 | 6 | 0 | 1 | 56 | A | 60 | A |
| 2-3 | | 10.1 | 3.1 | 1.1 | 0.26 | 4.2 | 0.31 | 7 | 0 | 5 | 51 | A | 59 | B |
| 2-4 | | 9.1 | 2.5 | 0.7 | 0.24 | 3.2 | 0.27 | 5 | 0 | 7 | 45 | B | 64 | A |
| 2-5 | | 10.4 | 2.5 | 0.6 | 0.25 | 3.1 | 0.24 | 7 | 0 | 9 | 41 | B | 34 | C |
| 2-6 | | 8.8 | 3 | 1.1 | 0.24 | 4.1 | 0.34 | 8 | 0 | 2 | 55 | A | 62 | A |
| 2-7 | | 9.4 | 3.9 | 1.1 | 0.26 | 5.0 | 0.41 | 12 | 3 | 1 | 61 | A | 60 | A |
| 2-8 | | 9.1 | 2.7 | 1.4 | 0.23 | 4.1 | 0.30 | 11 | 2 | 0 | 63 | A | 55 | B |
| 2-9 | | 7.6 | 3.5 | 1.5 | 0.25 | 5.0 | 0.46 | 10 | 2 | 0 | 58 | A | 61 | A |
| 2-10 | | 10.4 | 3.6 | 1.9 | 0.24 | 5.5 | 0.35 | 16 | 5 | 2 | 56 | A | 63 | A |
| 2-101 | | 4.8 | 2.2 | 1.4 | 0.25 | 3.6 | 0.46 | 6 | 0 | 0 | 71 | A | 29 | D |
| 2-102 | | 8.1 | 2.8 | 0 | 0.26 | 2.8 | 0.35 | 7 | 0 | 12 | 24 | C | 20 | D |
| 2-103 | | 9.6 | 0 | 1 | 0.25 | 1.0 | 0.00 | 1 | 0 | 14 | 22 | C | 23 | D |

As shown in Table 2, it is understood that, in the case where the cooling rate in the casting process is slow cooling, Sample Nos. 2-1 to 2-10 satisfying the total area rate of the group A precipitate and the group B precipitate of greater than or equal to 4% and less than or equal to 16% have a higher residual axial force and a higher proof stress at 150° C. compared to Sample Nos. 2-102 and 2-103 having a large area rate of the $Mg_{17}Al_{12}$ phase. It seems that Sample No. 2-101 has, due to a low content of Al, an inherently low proof stress at room temperature and a low 0.2% proof stress at 150° C.

Test Example 3

Each magnesium alloy member was produced using a magnesium alloy, and the magnesium alloy member was subjected to cross-sectional observation as well as evaluation of heat resistance and state of cracks.

[Preparation of Samples]

As a raw material, a 50 kg lump of pure magnesium having a purity of 99.9 mass % was prepared in the same manner as in Test Example 1, and melted at 690° C. using a melting furnace in an Ar atmosphere to prepare a pure magnesium melt. To the completely melted pure magnesium melt, lumps of the following elements 1 to 4 to be added were added to prepare magnesium alloy melts each having the composition shown in Table 3 or 4. The elements to be added were added and dissolved by stirring for 10 minutes with a rod-shaped jig in a state where the temperature of the melt was held at 690° C.

1. A pure aluminum lump having a purity of 99.9 mass %
2. A Sr lump having a purity of 99 mass %
3. A Ca lump having a purity of 99.5 mass %
4. An aluminum mother alloy (Al—10 mass % Mn)

A magnesium alloy member was produced using each of the prepared magnesium alloy melt samples. For the production of the magnesium alloy member, a cold chamber die casting machine (model number UB530iS2, manufactured by UBE MACHINERY CORPORATION, Ltd.) was used. The cooling rate in the casting process was 100 to 400° C./sec.

In this example, ring-shaped magnesium alloy members were produced in the same manner as in Test Example 1 for the evaluation of heat resistance. In addition, in this example, magnesium alloy members each including a boss and ribs protruding from the boss were produced (see FIGS. 2A and 2B) for the evaluation of cracks. The values of T1, T2, and T3 in the magnesium alloy member samples were as follows, where T2 (mm) is the thickness of the boss in the protruding direction of the rib, T3 (mm) is the length of the boss in the direction orthogonal to the protruding direction of the rib, and T1 (mm) is the thickness of the rib. In Sample Nos. 3-1-1 to 3-1-7, T1 was 5 mm, T2 was 10 mm, and T3 was 35 mm. In Sample Nos. 3-2-1 to 3-2-7, T1 was 4 mm, T2 was 12 mm, and T3 was 34 mm. In Sample Nos. 3-3-1 to 3-3-7, T1 was 4 mm, T2 was 16 mm, and T3 was 42 mm. In Sample Nos. 3-4-1 to 3-4-7, T1 was 3 mm, T2 was 15 mm, and T3 was 40 mm. In Sample Nos. 3-5-1 to 3-5-7, T1 was 3 mm, T2 was 21 mm, and T3 was 52 mm. In Sample Nos. 3-6-1 to 3-6-7, T1 was 2 mm, T2 was 20 mm, and T3 was 50 mm. In Sample Nos. 3-7-1 to 3-7-7, T1 was 2 mm, T2 was 30 mm, and T3 was 70 mm. The "Thickness ratio" shown in Tables 3 and 4 is the value of T2/T1.

[Cross-Sectional Observation]

A cross section of each of the produced magnesium alloy member samples was sampled, and the structure of the sample was observed with a scanning electron microscope (SEM) in the same manner as in Test Example 1. The cross section was sampled using a commercially available cross section polisher (CP) processing device. An arbitrary observation field of view was sampled in the CP cross section.

The area rate of individual precipitate or phases was determined using the SEM micrograph. Specifically, the precipitates present in the observation field of view Sf (350 μm×250 μm) were individually extracted as for the total of the group A precipitate and the group B precipitate, the group C precipitate, and the $Mg_{17}Al_{12}$ phase, the total areas Sm of the individually extracted precipitates were determined, and the values of (Sm/Sf)×100% were determined as the area rates of the individually extracted precipitates in the cross section. In this example, the number of observation fields of view was ten, and the average of area rates in the ten observation fields of view was defined as the area rate (%) of the individually extracted precipitate or phases in each sample. The results are collectively shown in Tables 3 and 4. In Tables 3 and 4, "group A+group B" is the total area rate of the group A precipitate and the group B precipitate, and "group C" is the area rate of the group C precipitate. The group A precipitate includes at least one phase selected from the $Al_2Sr$ phase, the $Al_4Sr$ phase, the $(Mg, Al)_2Sr$ phase, and the $(Mg, Al)_4Sr$ phase. The group B precipitate includes at least one phase selected from the $Al_2Ca$ phase and the $(Mg, Al)_2Ca$ phase. The group C precipitate includes at least one phase selected from the $Al_{17}Sr_8$ phase and the $Mg_{17}Sr_2$ phase. The cross-sectional area of each precipitate can be readily measured using a binarized image obtained by binarizing a micrograph (SEM micrograph) with an image processing apparatus.

[Evaluation of Heat Resistance]

Residual Axial Force

The residual axial force of each of the produced magnesium alloy member samples was measured in the same manner as in Test Example 1. Specifically, each of the magnesium alloy member samples and an aluminum block material were fastened together with an iron bolt to produce a test member, the test member was subjected to heat treatment, and the residual axial force (%) was determined from the amount of strain of the bolt before and after the heat treatment. The test member was produced by providing, in an appropriate position of the block material, a bolt hole having the same diameter as that of the hole in the magnesium alloy member sample, aligning the bolt hole with the hole in the magnesium alloy member sample, and tightening the iron bolt for fastening. The conditions of the heat treatment were a temperature of 150° C. and a holding time of 170 hours. The amount of strain was determined using a commercially available strain gauge installed on the bolt. The residual axial force was calculated from [(St−So)/So]×100(%), where So is the amount of strain of the bolt immediately after fastening and before heating to 150° C., and St is the amount of strain of the bolt after being subjected to the thermal history of 150° C.×170 hours. The amount of strain So before heating was the amount of strain after the bolt was tightened with an initial tightening axial force of 9 N. The results of the residual axial force and evaluations A to C of the residual axial force are collectively shown in Tables 3 and 4. In the evaluation A, the residual axial force was greater than or equal to 60%, in the evaluation B, the residual axial force was greater than or equal to 50% and less than 60%, and in the evaluation C, the residual axial force was less than 50%.

[Evaluation of Cracks]

The state of cracks of each of the produced magnesium alloy member samples was evaluated. In this example, ten magnesium alloy members were prepared for each of the produced samples, and the number of cracks in each magnesium alloy member was checked by visual inspection. Then, a value obtained by dividing the total number of cracks in the magnesium alloy members by the number of magnesium alloy members (ten) was calculated as the average of number of cracks of the ten magnesium alloy members, and defined as the number of cracks (sites) in each sample. The results of the number of cracks and evaluations A to C of the number of cracks are collectively shown in Tables 3 and 4. In the evaluation A, the number of cracks was 0, in the evaluation B, the number of cracks was greater than 0 and less than 1, and in the evaluation C, the number of cracks was greater than or equal to 1.

[Comprehensive Evaluation]

The comprehensive evaluation of the residual axial force evaluation and crack evaluation are shown in Tables 3 and 4. In the comprehensive evaluation A, the evaluations of both the residual axial force and cracks were A, in the comprehensive evaluation B, at least one of the evaluations of the residual axial force and cracks was B, and in the comprehensive evaluation C, at least one of the evaluations of the residual axial force and cracks was C.

TABLE 3

| Sample No. | Alloy composition Al (mass %) | Sr (mass %) | Ca (mass %) | Mn (mass %) | Thickness ratio (%) | Area rate of precipitate group A + group B (%) | group C (%) | $Mg_{17}Al_{12}$ phase (%) | Residual axial force (%) | Evaluation | Average number of cracks (sites) | Evaluation | Evaluation |
|---|---|---|---|---|---|---|---|---|---|---|---|---|---|
| 3-1-1 | 8.8 | 3 | 0.6 | 0.31 | 2 | 13 | 0 | 0 | 60 | A | 0 | A | A |
| 3-1-2 | 8.8 | 2.5 | 1.2 | 0.32 | | 15 | 0 | 0 | 64 | A | 0 | A | A |
| 3-1-3 | 8.8 | 3.6 | 1.6 | 0.28 | | 27 | 7 | 0 | 68 | A | 0 | A | A |
| 3-1-4 | 9.8 | 2.8 | 0.8 | 0.26 | | 16 | 0 | 3 | 52 | B | 0 | A | B |
| 3-1-5 | 12.3 | 2.2 | 0.5 | 0.2 | | 12 | 0 | 9 | 28 | C | 0 | A | C |
| 3-1-6 | 9.2 | 0.8 | 1.3 | 0.23 | | 8 | 0 | 7 | 34 | C | 0 | A | C |
| 3-1-7 | 9.1 | 4.1 | 3.2 | 0.26 | | 31 | 12 | 0 | 59 | B | 2 | C | C |
| 3-2-1 | 8.8 | 3 | 0.6 | 0.31 | 3 | 13 | 0 | 0 | 60 | A | 0 | A | A |
| 3-2-2 | 8.8 | 2.5 | 1.2 | 0.32 | | 15 | 0 | 0 | 64 | A | 0 | A | A |
| 3-2-3 | 8.8 | 3.6 | 1.6 | 0.28 | | 27 | 7 | 0 | 68 | A | 0 | A | A |
| 3-2-4 | 9.8 | 2.8 | 0.8 | 0.26 | | 16 | 0 | 3 | 52 | B | 0 | A | B |
| 3-2-5 | 12.3 | 2.2 | 0.5 | 0.2 | | 12 | 0 | 9 | 28 | C | 0 | A | C |
| 3-2-6 | 9.2 | 0.8 | 1.3 | 0.23 | | 8 | 0 | 7 | 34 | C | 0 | A | C |
| 3-2-7 | 9.1 | 4.1 | 3.2 | 0.26 | | 31 | 12 | 0 | 59 | B | 2.2 | C | C |
| 3-3-1 | 8.8 | 3 | 0.6 | 0.31 | 4 | 13 | 0 | 0 | 60 | A | 0 | A | A |
| 3-3-2 | 8.8 | 2.5 | 1.2 | 0.32 | | 15 | 0 | 0 | 64 | A | 0 | A | A |

TABLE 3-continued

| Sample No. | Alloy composition Al (mass %) | Sr (mass %) | Ca (mass %) | Mn (mass %) | Thickness ratio (%) | Area rate of precipitate group A + group B (%) | group C (%) | $Mg_{17}Al_{12}$ phase (%) | Residual axial force (%) | Evaluation | Average number of cracks (sites) | Evaluation | Evaluation |
|---|---|---|---|---|---|---|---|---|---|---|---|---|---|
| 3-3-3 | 8.8 | 3.6 | 1.6 | 0.28 | | 27 | 7 | 0 | 68 | A | 0 | A | A |
| 3-3-4 | 9.8 | 2.8 | 0.8 | 0.26 | | 16 | 0 | 3 | 52 | B | 0 | A | B |
| 3-3-5 | 12.3 | 2.2 | 0.5 | 0.2 | | 12 | 0 | 9 | 28 | C | 0 | A | C |
| 3-3-6 | 9.2 | 0.8 | 1.3 | 0.23 | | 8 | 0 | 7 | 34 | C | 0.3 | B | C |
| 3-3-7 | 9.1 | 4.1 | 3.2 | 0.26 | | 31 | 12 | 0 | 59 | B | 2.5 | C | C |
| 3-4-1 | 8.8 | 3 | 0.6 | 0.31 | 5 | 13 | 0 | 0 | 60 | A | 0 | A | A |
| 3-4-2 | 8.8 | 2.5 | 1.2 | 0.32 | | 15 | 0 | 0 | 64 | A | 0 | A | A |
| 3-4-3 | 8.8 | 3.6 | 1.6 | 0.28 | | 27 | 7 | 0 | 68 | A | 0 | A | A |
| 3-4-4 | 9.8 | 2.8 | 0.8 | 0.26 | | 16 | 0 | 3 | 52 | B | 0 | A | B |
| 3-4-5 | 12.3 | 2.2 | 0.5 | 0.2 | | 12 | 0 | 9 | 28 | C | 0 | A | C |
| 3-4-6 | 9.2 | 0.8 | 1.3 | 0.23 | | 8 | 0 | 7 | 34 | C | 0.8 | B | C |
| 3-4-7 | 9.1 | 4.1 | 3.2 | 0.26 | | 31 | 12 | 0 | 59 | B | 3.1 | C | C |

TABLE 4

| Sample No. | Alloy composition Al (mass %) | Sr (mass %) | Ca (mass %) | Mn (mass %) | Thickness ratio (%) | Area rate of precipitate group A + group B (%) | group C (%) | $Mg_{17}Al_{12}$ phase (%) | Residual axial force (%) | Evaluation | Average number of cracks (sites) | Evaluation | Evaluation |
|---|---|---|---|---|---|---|---|---|---|---|---|---|---|
| 3-5-1 | 8.8 | 3 | 0.6 | 0.31 | 7 | 13 | 0 | 0 | 60 | A | 0.1 | B | B |
| 3-5-2 | 8.8 | 2.5 | 1.2 | 0.32 | | 15 | 0 | 0 | 64 | A | 0 | A | A |
| 3-5-3 | 8.8 | 3.6 | 1.6 | 0.28 | | 27 | 7 | 0 | 68 | A | 0.5 | B | B |
| 3-5-4 | 9.8 | 2.8 | 0.8 | 0.26 | | 16 | 0 | 3 | 52 | B | 0 | A | B |
| 3-5-5 | 12.3 | 2.2 | 0.5 | 0.2 | | 12 | 0 | 9 | 28 | C | 0.8 | B | C |
| 3-5-6 | 9.2 | 0.8 | 1.3 | 0.23 | | 8 | 0 | 7 | 34 | C | 1.7 | C | C |
| 3-5-7 | 9.1 | 4.1 | 3.2 | 0.26 | | 31 | 12 | 0 | 59 | B | 4.2 | C | C |
| 3-6-1 | 8.8 | 3 | 0.6 | 0.31 | 10 | 13 | 0 | 0 | 60 | A | 0.4 | B | B |
| 3-6-2 | 8.8 | 2.5 | 1.2 | 0.32 | | 15 | 0 | 0 | 64 | A | 0.2 | B | B |
| 3-6-3 | 8.8 | 3.6 | 1.6 | 0.28 | | 27 | 7 | 0 | 68 | A | 0.8 | B | B |
| 3-6-4 | 9.8 | 2.8 | 0.8 | 0.26 | | 16 | 0 | 3 | 52 | B | 0.1 | B | B |
| 3-6-5 | 12.3 | 2.2 | 0.5 | 0.2 | | 12 | 0 | 9 | 28 | C | 1.5 | C | C |
| 3-6-6 | 9.2 | 0.8 | 1.3 | 0.23 | | 8 | 0 | 7 | 34 | C | 2.7 | C | C |
| 3-6-7 | 9.1 | 4.1 | 3.2 | 0.26 | | 31 | 12 | 0 | 59 | B | 5.8 | C | C |
| 3-7-1 | 8.8 | 3 | 0.6 | 0.31 | 15 | 13 | 0 | 0 | 60 | A | 1.5 | C | C |
| 3-7-2 | 8.8 | 2.5 | 1.2 | 0.32 | | 15 | 0 | 0 | 64 | A | 1.2 | C | C |
| 3-7-3 | 8.8 | 3.6 | 1.6 | 0.28 | | 27 | 7 | 0 | 68 | A | 1.7 | C | C |
| 3-7-4 | 9.8 | 2.8 | 0.8 | 0.26 | | 16 | 0 | 3 | 52 | B | 1.1 | C | C |
| 3-7-5 | 12.3 | 2.2 | 0.5 | 0.2 | | 12 | 0 | 9 | 28 | C | 2.1 | C | C |
| 3-7-6 | 9.2 | 0.8 | 1.3 | 0.23 | | 8 | 0 | 7 | 34 | C | 4.5 | C | C |
| 3-7-7 | 9.1 | 4.1 | 3.2 | 0.26 | | 31 | 12 | 0 | 59 | B | 6.4 | C | C |

First, as for the evaluation of cracks, as shown in Tables 3 and 4, it is understood that the magnesium alloy member is more likely to crack as the thickness ratio is larger. For example, in the case where the thickness ratio was 2 or 3, the number of cracks was 0 in all the samples except for Sample Nos. 3-1-7 and 3-2-7, but in the case where the thickness ratio was 10, the number of cracks was greater than 0 and less than 1 in Sample Nos. 3-6-1 to 3-6-4, and was greater than or equal to 1 in Sample Nos. 3-6-5 to 3-6-7, and in the case where the thickness ratio was 15, the number of cracks was greater than or equal to 1 in all the samples.

In addition, as shown in Tables 3 and 4, it is understood that a sample satisfying the total area rate of the group A precipitate and the group B precipitate of greater than or equal to 2.5% and less than or equal to 30% is unlikely to crack even in the case where the thickness ratio is large. Specifically, in the case where the thickness ratio was 4 or 5, the number of cracks was 0 in Sample Nos. 3-3-1 to 3-3-5 and 3-4-1 to 3-4-5, and the number of cracks was greater than 0 and less than 1 in Sample Nos. 3-3-6 and 3-4-6. In the case where the thickness ratio was 7, the number of cracks was 0 in Sample Nos. 3-5-2 and 3-5-4, and the number of cracks was greater than 0 and less than 1 in Sample Nos. 3-5-1, 3-5-3, and 3-5-5. In the case where the thickness ratio was 10, the number of cracks was greater than 0 and less than 1 in Sample Nos. 3-6-1 to 3-6-4.

Furthermore, as shown in Tables 3 and 4, it is understood that in the case where the thickness variation is larger as indicated by the thickness ratio of greater than or equal to 7, a sample that satisfies a total area rate of the group A precipitate and the group B precipitate of greater than or equal to 2.5% and less than or equal to 30% and including small amounts of the group C precipitate and the $Mg_{17}Al_{12}$ phase is certainly unlikely to crack as long as the thickness ratio is less than 15. Specifically, even in the case where the thickness ratio was as large as 10, the number of cracks was greater than 0 and less than 1 in Sample Nos. 3-6-1 to 3-6-4.

Next, as for the evaluation of the residual axial force, as shown in Tables 3 and 4, it is understood that a sample that satisfies a total area rate of the group A precipitate and the group B precipitate of greater than or equal to 2.5% and less than or equal to 30% and including relatively small amounts of the group C precipitate and the $Mg_{17}Al_{12}$ phase has a relatively high residual axial force. For example, Sample Nos. 3-1-1 to 3-1-4, Sample Nos. 3-2-1 to 3-2-4, Sample Nos. 3-3-1 to 3-3-4, Sample Nos. 3-4-1 to 3-4-4, Sample Nos. 3-5-1 to 3-5-4, Sample Nos. 3-6-1 to 3-6-4, and Sample Nos. 3-7-1 to 3-7-4 had a residual axial force of greater than or equal to 50%.

From the above, it is understood that a magnesium alloy member, which has the group A precipitate and the group B precipitate that contribute to the improvement of the high-temperature strength in a specific range, is unlikely to crack during casting even when it has a complicated shape that has an integrally molded portion having a large thickness variation. In particular, it is understood that a magnesium alloy member, which has the group A precipitate and the group B precipitate in a specific range, and has relatively small amounts of the group C precipitate and the $Mg_{17}Al_{12}$ phase as precipitates that reduce the high-temperature strength, is certainly unlikely to crack during casting even when it has a complicated shape having a larger thickness variation. Further, it is understood that a magnesium alloy member, which has the group A precipitate and the group B precipitate in a specific range, and has relatively small amounts of the group C precipitate and the $Mg_{17}Al_{12}$ phase as precipitates that reduce the high-temperature strength, can suppress the reduction of the residual axial force.

It should be understood that the embodiments and examples disclosed herein are illustrative in all aspects and are not restrictive. The scope of the present invention is shown not by the above-mentioned embodiments and examples but by the scope of claims, and is intended to include all the modifications within the meaning and scope equivalent to the scope of claims.

REFERENCE SIGNS LIST

1: magnesium alloy member, 2: boss (base part), 3: rib (plate part), 4: pedestal, T1, T2: thickness, T3: length

The invention claimed is:

1. A magnesium alloy containing Al, Sr, Ca, and Mn, with a balance being Mg and inevitable impurities, the magnesium alloy comprising:

a structure having an α-Mg phase, and a precipitate dispersed in at least one of a grain boundary of the α-Mg phase and a cell boundary, the precipitate including:

at least one phase selected from a group A consisting of an $Al_2Sr$ phase, an $Al_4Sr$ phase, a $(Mg, Al)_2Sr$ phase, and a $(Mg, Al)_4Sr$ phase;

at least one phase selected from a group B consisting of an $Al_2Ca$ phase and a $(Mg, Al)_2Ca$ phase;

at least one phase selected from a group C consisting of an $Al_{17}Sr_8$ phase and a $Mg_{17}Sr_2$ phase; and a $Mg_{17}Al_{12}$ phase, wherein the magnesium alloy has, in a cross section:

a total area rate of a group A precipitate and a group B precipitate of greater than or equal to 15% and less than or equal to 25%;

an area rate of a group C precipitate of less than or equal to 7%; and an area rate of the $Mg_{17}Al_{12}$ phase of less than or equal to 5%.

2. A magnesium alloy member comprising the magnesium alloy according to claim 1, and comprising a base part, and a plate part integrally molded with the base part to protrude from the base part, the base part having a thickness in a protruding direction of the plate part of greater than or equal to five times a thickness of the plate part.

3. The magnesium alloy member according to claim 2, wherein the base part has a length in a direction intersecting with the protruding direction of the plate part of greater than or equal to five times the thickness of the plate part.

* * * * *